United States Patent [19]

Inage

[11] Patent Number: 4,464,062

[45] Date of Patent: Aug. 7, 1984

[54] BATTERY POWERED TIME PIECE

[76] Inventor: Kuniyoshi Inage, 393, Iwaicho, Hodogaya-ku, Yokohama-shi, Kanagawa, 240, Japan

[21] Appl. No.: 314,410

[22] Filed: Oct. 23, 1981

[30] Foreign Application Priority Data

| | | | |
|---|---|---|---|
| Jul. 10, 1981 | [JP] | Japan | 56-101786 |
| Jul. 10, 1981 | [JP] | Japan | 56-101787 |
| Jul. 10, 1981 | [JP] | Japan | 56-101788 |
| Jul. 10, 1981 | [JP] | Japan | 56-101789 |

[51] Int. Cl.[3] ..... G04B 19/02

[52] U.S. Cl. ..... 368/220; 368/204; 368/196

[58] Field of Search ..... 368/196, 197, 198, 145, 368/203, 146, 204, 276, 220, 317, 221, 76, 245, 88

[56] References Cited

U.S. PATENT DOCUMENTS

| | | | |
|---|---|---|---|
| 3,858,389 | 1/1975 | Isuruishi | 368/245 |
| 3,879,930 | 4/1975 | Burici | 368/220 |
| 4,270,834 | 6/1981 | Wolber et al. | 368/204 |
| 4,276,634 | 6/1981 | Assmus et al. | 368/204 |

*Primary Examiner*—Forester W. Isen

[57] ABSTRACT

A battery operated time piece including a movement casing, slip means for the minute wheel, terminal members, correction means for the minute wheel, a sounder, an adjuster to control the level of the sounder. All these elements are of simple structure which eliminates the need for troublesome assembly procedure.

6 Claims, 27 Drawing Figures

BATTERY POWERED TIME PIECE

The present invention relates to a slip device for a minute shaft of a timepiece and a minute wheel which is coupled on an end of the minute shaft.

A minute shaft carries a minute wheel at one end and a minute hand at the other end so that the minute wheel in rotation drives the minute shaft to cause the minute hand to show a time. It is often required to correct an error in the time indicated by the minute hand.

The present invention is concerned with a slip device which permits the minute wheel and minute shaft to slip relative to each other in the event of such error correction.

A prior art slip device having the above-mentioned function is illustrated in FIG. 1.

FIG. 1(A) is a plan view of a minute wheel; FIG. 1(B) is a side elevation of a minute shaft; FIG. 1(C) is a view similar to FIG. 1(B) but showing the minute shaft in a position rotated 90° therefrom; FIGS. 1(D) and 1(E) are a plan view and a side elevation of a spring, respectively; and FIG. 1(F) shows the minute wheel coupled to the minute shaft through the spring.

As viewed in FIG. 1(B), the minute shaft 2 is formed with a flange 3 and a projection or stub 4 integrally at one end thereof. The stub 4 has a pair of parallel recesses or grooves 5 on its outer periphery. A pair of flanges 4*a*, 4*b* are therefore formed on the stub 4 in perpendicular relation to the grooves 5.

As shown in FIG. 1(D), the spring 6 comprises a generally U-shaped thin plate which has a pair of legs 7 connected together by the intermediate portion. The inner edge of each leg 7 is formed with a pair of lugs 8 which face those on the inner edge of the other leg 7, respectively. Each leg 7 has a curved configuration as viewed in the side elevation of FIG. 1(E).

In assembly, the minute wheel is coupled on the stub 4 of the minute shaft 2 whereupon the opposite legs 7 of the spring 6 are placed in the respective grooves 5 on the stub 4 such that their lug pairs 8 hold the stub 4 therebetween [see FIG. 1(F)].

In this situation, the raised portions of the curved legs 7 are pressed by the flange 4*b* of the shaft 2 and, as a result, the spring 6 resiliently urges the minute wheel 1 against the flange 3 of the shaft 2 at its leg ends and the portion which interconnects the legs. The shaft 2 is thus allowed to rotate while slipping relative to the minute wheel 1.

FIG. 2 illustrates another known slip device which employs the minute wheel itself for resiliently holding the minute shaft, instead of the spring 6.

As shown in FIG. 2(A), a minute wheel 9 comprises an annular member having a pair of legs 10 which extend radially inwardly from the annulus. A minute shaft 11 on the other hand has at one end thereof flanges 12, 13 and a stub 14 intermediate between the flanges 12, 13, which are all formed integrally with each other. The stub 14 on the shaft 11 is resiliently embraced by the opposite legs 10 on the minute wheel 9 [see FIG. 2(C)]. With this arrangement, the shaft 11 is movable slipping relative to the minute wheel 9.

As has been described, the prior art slip devices rely on a resilient pressing force afforded by a spring or a resilient nipping force afforded by a pair of legs on a minute wheel. However, the spring or the legs on the minute wheel cannot exert pressing or nipping forces other than predetermined ones due to the specific geometry thereof. This makes it impossible to increase or decrease the rotary torque of the minute shaft as desired. Concerning the device which nips the shaft between the legs on the minute wheel, smooth reversible rotation of the shaft is unattainable unless a lubricant such as oil is applied to the sliding surfaces between the shaft and legs.

It is an object of the present invention to provide a slip device which not only promotes smooth reversible rotation of the minute shaft but permits a control on the rotation torque yet without causing any variation in the rotating effort.

FIGS. 1(A)–1(F) illustrate a prior art slip device for a minute wheel of a timepiece, in which FIG. 1(A) is a plan view of a minute wheel, FIGS. 1(B) and 1(C) are side elevations of a minute shaft in different positions, FIGS. 1(D) and 1(E) are a plan view and a side elevation of a spring, respectively, and FIG. 1(F) is a rear end view of the minute wheel coupled on the minute shaft through the spring;

FIGS. 2(A)–2(C) show another prior art slip device, in which FIG. 2(A) is a plan view of a minute wheel, FIG. 2(B) a side elevation of a minute shaft and FIG. 2(C) a rear view of the minute wheel coupled on the minute shaft; and FIGS. 3–5 illustrate a slip device embodying the present invention, in which FIG. 3 is a plan view of a minute wheel, FIG. 4 a side elevation of a minute shaft and FIG. 5 a plan view of a spring coactive with the minute wheel.

FIGS. 6(A) and 6(B) are front views of prior art terminal plates, in which FIG. 6(A) shows a positive terminal plate and FIG. 6(B) a negative terminal plate;

FIGS. 7(A), 7(B) and 8(A), 8(B) illustrate another embodiment, in which FIGS. 7(A) and 8(A) are front views of a positive terminal plate and a negative terminal plate, respectively, and FIGS. 7(B) and 8(B) are side elevations of the same;

One embodiment of the present invention will now be described with reference to FIGS. 3–5.

Figure 3:
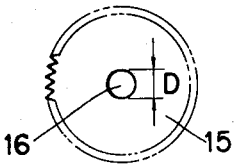
Figure 4:
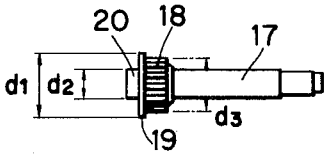
Figure 5:
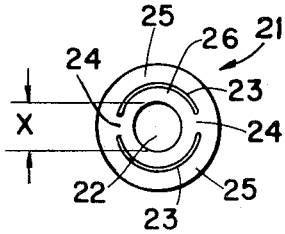

FIG. 3 shows a minute wheel, FIG. 4 a minute shaft and FIG. 5 a spring.

As viewed in FIG. 3, the minute wheel 15 is formed with a central opening 16 concentric with its axis.

As seen in FIG. 4, the shaft 17 has a pinion 18, a flange 19 and a stub 20 which are moulded integrally with one end of the shaft 17. The flange 19 has an outside diameter $d_1$ which is larger than the inside diameter D of the opening 16 of the minute wheel 15. The stub 20 has an outside diameter $d_2$ slightly smaller than the inside diameter D of the opening 16, permitting the minute wheel 15 to be coupled on the stub 20.

As indicated in FIG. 5, the spring 21 comprises an annular thin plate formed with a circular central opening 22. A pair of generally semicircular slots 23 are formed in symmetrical relation in the annulus of the spring 21.

Thus, the spring 21 consists of an outer annular portion 25 and an inner annular portion 26 which are isolated by the slots 23 except for a pair of diametrically opposite connecting portions 24 where they are contiguous with each other.

The inside diameter X of the opening 22 of the spring 21 is determined to be somewhat larger than the outside diameter $d_3$ of the pinion 18 on the shaft 17 but smaller than the outside diameter $d_1$ of the flange 19. With this geometrical relation, the spring 21 can be coupled on the pinion 18 of the shaft 17.

In assembly, the stub 20 on the shaft 17 is inserted into the opening 16 of the minute wheel 15 while the spring 21 is coupled on the pinion 18 of the shaft 17 through its opening 22. Then the outer annular portion 25 of the spring 21 is rigidly connected to the minute wheel 15 at a plurality of locations as by spot welding.

Under this condition, the flange 19 on the shaft 17 regulates the positions of the minute wheel 15 and spring 21. The inner annular portion 26 of the spring 21 resiliently presses the flange 19 so that the wheel 15 is retained on the shaft 17. This assembly will ensure smooth slippage between the wheel 15 and shaft 17 in the event of error correction.

The locations where the outer annular portion 25 of the spring 21 will be rigidly connected to the minute wheel 15 can be changed to vary the resilient pressing force of the inner annular portion 26 on the flange 19 of the shaft 17 and, therefore, the rotary torque of the shaft 17. Additionally, the slip mechanism described above eliminates the need of oil or like lubricant by utilizing the resilient force acting on the flange 19.

The embodiment of the present invention has been shown and described as employing a spring 21 which has a pair of generally semicircular slots 23 formed symmetrically therein. For finer adjustment of the rotorary torque, a pair of additional slots may be provided to the inner annular portion 26 of the spring 21 in perpendicular relation to the connecting portions 24.

It will thus be understood from the foregoing that, using a specially shaped spring to resiliently hold a flange of a minute shaft in coaction with a minute wheel, the present invention promotes smooth reversible rotation of the minute shaft, allows a control on the rotary torque and prevents any change in the rotating effort.

Another embodiment of the invention will be explained hereinafter.

The casing of a timepiece of the type described stores various electrical elements therein such as an electromagnet for driving the timepiece and an electromagnetically actuated sounder for time indication, together with a wheel mechanism.

Also stored in the casing are a printed circuit board carrying IC and other circuit elements for actuating such electrical parts, a dry element battery and terminal plates for establishing electrical conduction between the printed circuit board and battery.

Figure 6A:
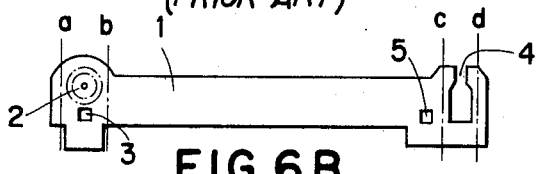
FIG.6A (PRIOR ART)
Figure 6B:
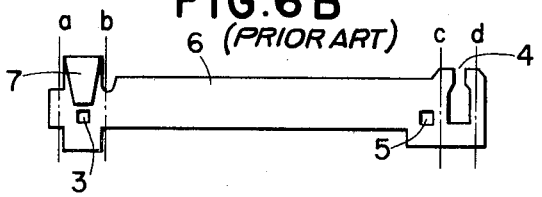
FIG.6B (PRIOR ART)

FIG. 6(A) shows a positive polarity terminal plate having a conventional configuration, and FIG. 6(B) a negative polarity terminal plate cooperative with the positive polarity terminal plate.

As shown, the positive terminal plate 1 comprises a strip of conductive and resilient material. The terminal plate 1 has at one end thereof a convex contact portion 2 to be engaged by the positive pole of a dry element battery, and a window 3 to receive a corresponding lug formed on an inner side wall of the casing. The other end of the terminal plate is formed with a slot 4 whose width is substantially the same as the thickness of the printed circuit board, thus being provided with a generally U-shaped configuration. This U-shaped end nips the printed circuit board in the slot 4 and is engaged by a terminal portion of the printed circuit board. A window 5 at this end of the terminal plate 1 will receive another lug on the inner side wall of the casing.

One end of the negative terminal plate 6 is turned over to form a tongue 7 which will be engaged by the negative pole of the dry element battery. Like the terminal member 1, the terminal member 6 is formed with a slot 4 and windows 3, 5 performing the functions common to those of the terminal member 1.

To assemble the terminal plates and printed circuit board together, the terminal plates 1, 6 are first inserted between the inner side walls of the casing and upright guide projections on the inner bottom wall of the casing (indicated by positions a-d in FIG. 6). Simultaneously, the windows 3, 5 of the terminal members 1, 6 are coupled on the corresponding lugs on the casings.

Then a printed circuit board is engaged in the slots 4, 4 of the terminal members 1, 6 which are now fixed in place within the casing. This establishes electrical contact between the printed circuit board and the terminal plates 1, 6.

This type of arrangement, however, is disadvantageous in the following aspects. Though the terminal plates 1, 6 are securely held in predetermined positions by the lugs and guide projections, the printed circuit board cannot be secured stably because it is simply received in the slots 4, 4 of the terminal members 1, 6. This, combined with the inherent line-to-line contact, is liable to result incomplete contact between the terminal members 1, 6 and printed circuit board. Additionally, the lugs, guide projections and the others for securing the terminal members 1, 6 to the casing add to the intricacy of construction while preventing easy removal of the terminal plates out of the casing.

Another embodiment of the present invention will be described with reference to FIGS. 7–10.

Figure 7A:
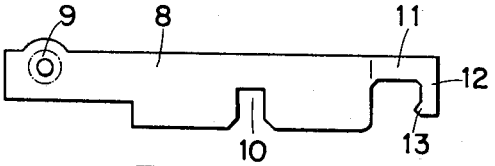
Figure 7B:
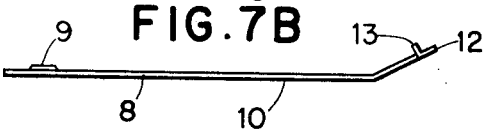

Referring to FIG. 7(A), a positive terminal plate 8 of another embodiment of the invention is in the form of a strip of resilient material such as stainless steel. The terminal plate 8 has a protuberance 9 at one end to be engaged by the positive pole of a dry element battery, and an inverted U-shaped notch 10 at the intermediate between its ends.

The other end of the terminal plate 8 is notched to constitute a generally L-shaped portion which includes a first tongue 11 and a second tongue 12 contiguous with the first tongue 11. As viewed in FIG. 7(B), the plane containing the tongues 11 and 12 is inclined inwardly at an obtuse angle relative to the general plane of the plate 8 a triangular third tongue 13 extends from the inner edge of the extreme end of the second tongue 12. This tongue 13 is bent inwardly substantially at a right angle to the second tongue 12.

Figure 8A:
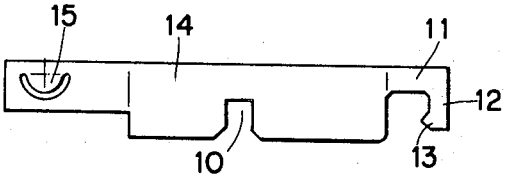
Figure 8B:
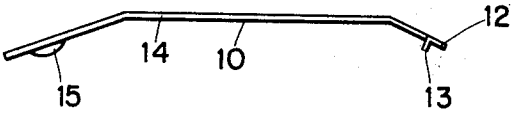

FIG. 8(A) illustrates a negative terminal plate 14 which will cooperate with the positive terminal plate 8. As shown, the terminal plate 14 has a tongue 15 which is formed by cutting and raising a part of one end of the plate 14 to be engaged by the negative pole of a dry element battery. Like the terminal plate 8, the terminal plate 14 is also provided with an inverted U-shaped notch 10, an L-shaped portion having first and second tongues 11, 12 and a third tongue 13.

Figure 10:
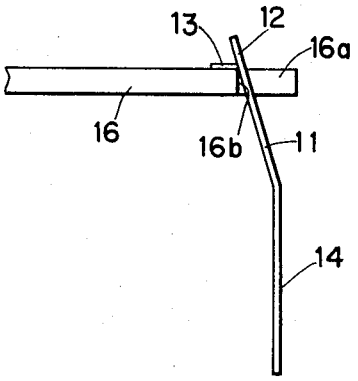
FIG. 10 is an enlarged view of an encircled portion of FIG. 9.

As viewed in FIG. 10, a printed circuit board 16 has upper portions at its opposite ends notched to define L-shaped edges or stepped portions individually.

The terminal plates 8, 14 and printed circuit board 16 will be assembled together by the following successive steps. The printed circuit board 16 is a first inserted at its opposite ends into corresponding channels 18 which are formed in the opposite inner side walls of a casing 17. Then each of the terminal members, 8, 14 is inserted into the casing 17 along the corresponding side wall until its U-shaped notch 10 is coupled on a projection 19 which protrudes from a lower portion of said inner side wall.

In such a position, as shown in FIG. 10 each terminal member 8 or 14 causes its first tongue 11 to press the horizontal edge 16*a* of the corresponding stepped portion of the printed circuit board 16 from above and, at the same time, to press the vertical edge 16*b* of the same stepped portion resiliently from the right or the left. Thus, the printed circuit board 16 is securely positioned by the coactive terminal members 8, 14. The triangular third tongues 13 on the terminal plates 8, 14 are now engaged in surface-to-surface relation with terminal portions which are positioned on one surface of the printed circuit board 16.

In summary, it will be seen that this embodiment provides terminal plates which set up failure-free electrical conduction between a printed circuit board and a battery once inserted by simple manipulation into a casing until they become coupled on projections on inner side walls of the casing. The terminal plates can be taken out of the casing with ease. These advantages result from such a design that the terminal members when so inserted cause their obtusely bent first tongues to resiliently press the printed circuit board from above and from the right and left to locate it in a fixed position; third tongues of the terminal members are in surface-to-surface contact with the printed circuit board.

Additionally, the casing needs only be formed with lugs for regulating positions of the terminal members therein and, therefore, its construction is simpler than that of conventional ones.

A still further embodiment of the present invention will be described with reference to the accompanying drawings.

Figure 9:
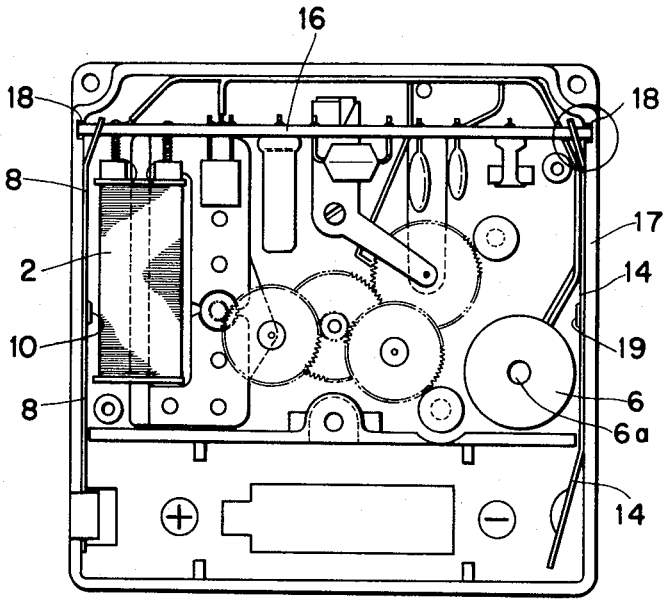
FIG. 9 is a front view of a printed circuit board and the terminal plates mounted in a movement casing.

Referring to FIG. 9 of the drawings the movement casing 17 stores therein an electromagnet 2 for driving the time-piece, a printed circuit board 16 carrying IC and other circuit elements, a wheel mechanism 4, terminal plates 8 etc. Also stored in the casing 17 is an electromagnetically operated sounder 6 having an opening 6*a* for radiation of sound therethrough.

Figure 11:
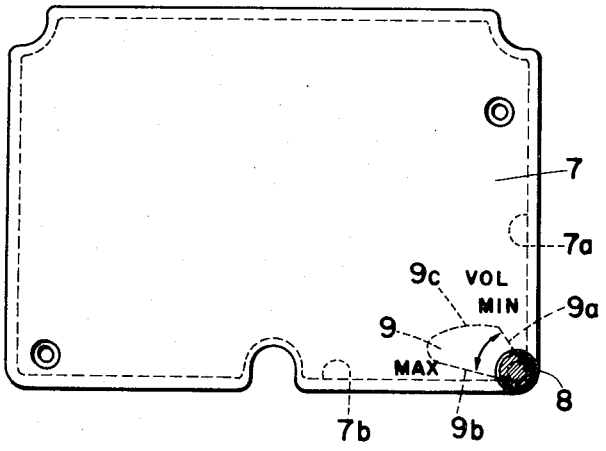
FIG. 11 is a plan view of a cover equipped with a volume adjuster embodying the present invention as viewed from the front side.

A cover 7 for closing the casing 1 is shown in plan in FIG. 11 which is a view seen from the front. The reference numeral 8 denotes a thumb piece made of a plastic and adapted to rotate a volume adjuster blade which will set up a controllable effective area of the opening 6*a* of the sounder 6 as will be described. The thumb piece 8 is carried on a shaft which is in turn passed through the cover 7 to rotate itself under friction.

The cover 7 may be impressed with a double-headed arrow to indicate movable directions of the thumb piece 8, and symbols "VOL", "MIN" and "MAX".

Figure 12:
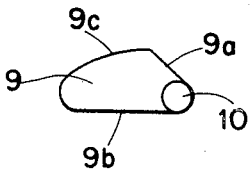
FIG. 12 is a plan view of a volume adjuster blade of the volume adjuster.

The volume adjuster blade 9 for controlling the effective area of the opening or sound outlet 6*a* is shown in detailed plan in FIG. 12. Formed of plastics, the blade 9 resembles a propeller blade and has straight edges 9*a*, 9*b* and an arcuate edge 9*c* which connects the straight edges to each other. The blade 9 is located to the rear of the cover 7 as viewed in FIG. 2 while the shaft 10 of the thumb piece 8 is secured to one end of the blade 9 by fusion.

With this arrangement, when the thumb piece 8 is manually rotated at the front of the cover 7, the blade 9 will be rotated together at a small spacing from the top of the sounder 6 at the rear of the cover 7.

Figure 13:
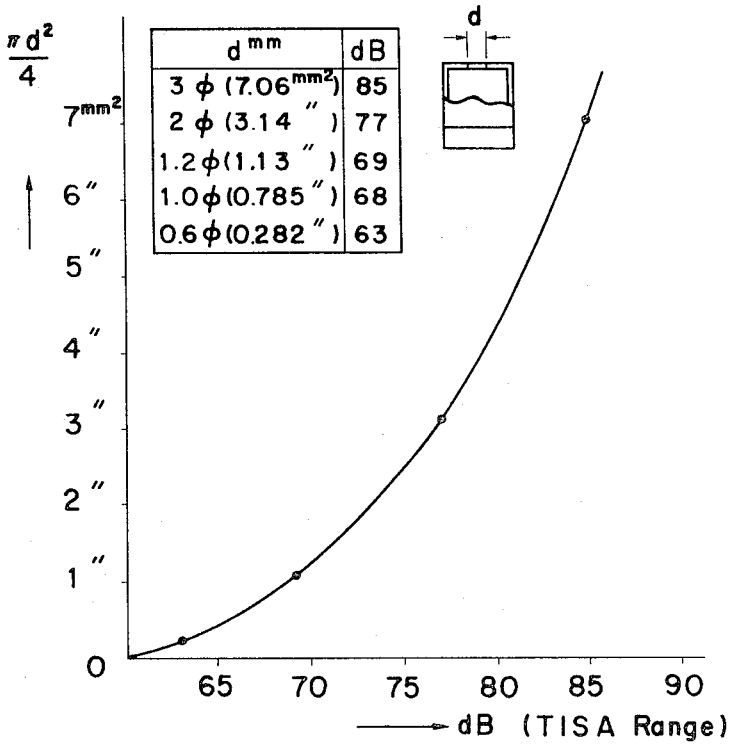
FIG. 13 is a graph showing a relationship between the effective area of a sound outlet and the sound pressure.

FIG. 13 shows a curve which represents the relationship between the effective area of the sound outlet 6*a* of the sounder and the sound pressure determined by a series of experiments. It will be seen from the curve that the sound pressure varies along a curve of the sound order with respect to the effective area of the sound outlet. Stated another way, the smaller the effective opening area, the larger the rate of variation (decrease) in the sound pressure.

This teaches that a linear variation in the sound pressure is achievable by slowing down the closing rate of the sound outlet 6*a*.

In this embodiment, the arcuate edge 9*c* of the blade 9 defines the front or line which closes (or opens) the sound outlet 6*a*. Thus, the open outlet area is variable at a reduced rate as viewed in FIG. 5 in accordance with the angular displacement of the blade 9 in the closing direction.

Figure 14:
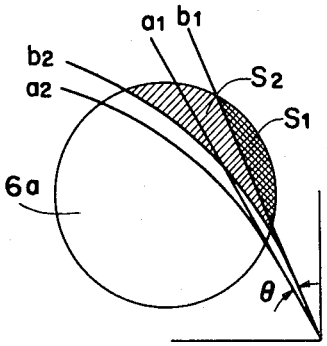
FIG. 14 is a diagram representative of different rates of variation in the effective open area of the sound outlet provided by differently shaped adjuster blades.

FIG. 14 is a diagram showing that the effective open area of the sound outlet 6*a* undergoes different rates of variation when closed by a blade having a rectilinear edge and that having an arcuate edge as the blade 9 of the present invention, respectively. The straight line $a_1$ indicates a position of the blade with a straight edge where a substantial part of the sound outlet 6*a* has been blocked, and the curved line $a_2$ indicates that of the blade with an arcuate edge. When the blade with the straight edge moves an angle $\theta$ from the position $a_1$ further to a position $b_1$, it will leave only a small area of the sound outlet 6*a* open as indicated by $S_1$. In contrast, the blade with the arcuate edge will leave a larger area of $S_7$ of the sound outlet 6*a* open even after the same angle $\theta$ of movement from the position $a_2$ to a position $b_2$. It will thus be seen that the closing rate obtainable with the arcuate edge is slower than that provided by the straight edge, resulting in a linear variation in the resonant quantity.

The cover 7 carrying the thumb piece 8 and adjuster blade 9 therewith is fastened to the casing by screws. Under this condition, the thumb piece is manipulatable to move the adjuster blade 9 angularly between a first position where the straight edge 9*b* abuts against an inner wall 7*b* of the cover and a second position where it abuts against another inner edge 7*a* of the same. At the first position which is indicated by "MAX", the blade 9 will widely open the sound outlet 6*a* of the sounder 6 to set up the maximum volume; at the second position indicated by "MIN", the blade 9 will leave the minimum area of the sound outlet 6a open setting up the minimum volume. An angular movement of the blade 9 between the first and second positions will vary the effective area of the sound outlet 6a in a linear fashion as determined by the arcuate edge 9c of the blade.

In summary, it will be seen that this embodiment provides a volume adjuster which facilitates a linear control of the volume of a sounder to any desired level within a given range while simply needing manipulation of the thumb piece 8 which protrudes from the cover 7. This volume adjuster is therefore simple in construction and easy to use while freeing the user and the others from annoyance.

Referring to FIG. 9 of the drawings, battery powered timepiece comprises a movement casing 1 which stores various component elements therein such as an electromagnet 2 for driving the timepiece, a printed circuit board 3 provided with IC and other circuit elements thereon and cooperative terminal plates 4. Together with these elements, the casing 1 also containes a wheel train or mechanism 5 which includes a correction wheel 6.

Figure 15A:
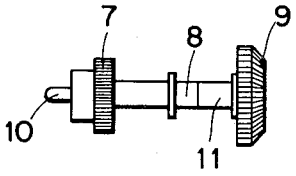
FIG. 15(A) is an enlarged side elevation of a corrector element which comprises an integral moulding of a correction wheel and its associated parts.
Figure 15B:
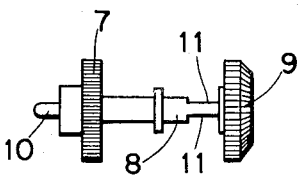
FIG. 15(B) is an enlarged side elevation showing the corrector element of FIG. 15(A) but in a position rotated 90° in either direction.

Referring now to FIGS. 15(A) and 15(B), the corrector element of the still further embodiment comprises a correction wheel 7, a rotary shaft 8, a thumb piece 9 and a projection or stub 10 which are moulded integrally using a plastic. At a part adjacent to the thumb piece 9, the shaft 8 is locally notched in parallel with the axis thereof to have a pair of flat faces 11 which are parallel to each other.

Figure 16:
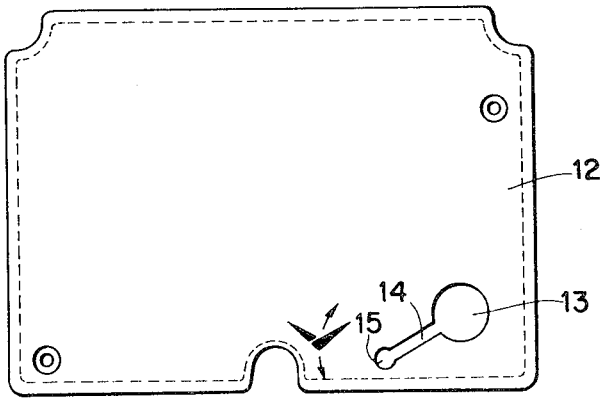
FIG. 16 is a plan view of a cover as seen from the outside thereof.

The casing 1 has a cover 12 shown in FIG. 16 which is formed with a circular opening 13 of a given diameter. A slot 14 extends radially outwardly from the circular opening 13 to terminate at a second circular opening 15 whose diameter is smaller than that of the opening 13. The cover 12 may be impressed with arrows indicating movable directions of the thumb piece 9, and a figure indicating the kind of function the thumb piece 9 performs.

Figure 1A:
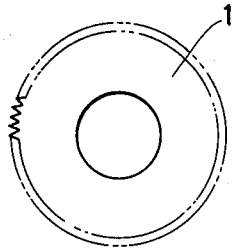
FIG.1A (PRIOR ART)
Figure 1B:
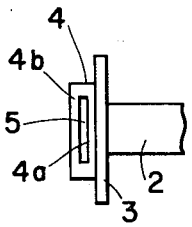
FIG.1B (PRIOR ART)
Figure 1C:
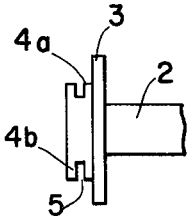
FIG.1C (PRIOR ART)
Figure 1D:
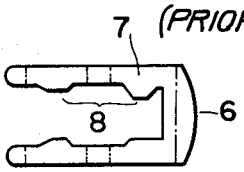
FIG.1D (PRIOR ART)
Figure 1E:
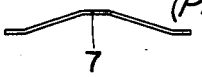
FIG.1E (PRIOR ART)
Figure 1F:
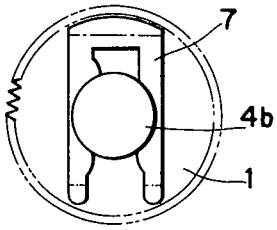
FIG.1F (PRIOR ART)
Figure 2A:
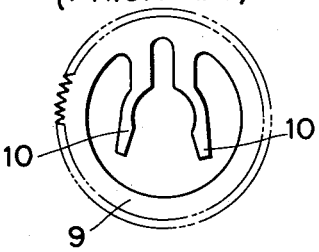
FIG.2A (PRIOR ART)
Figure 2B:
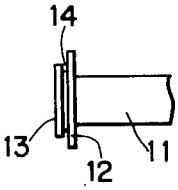
FIG.2B (PRIOR ART)
Figure 2C:
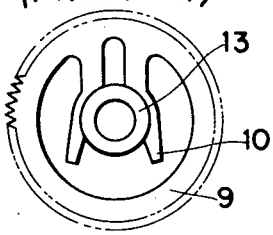
FIG.2C (PRIOR ART)

The diameter of the larger opening 13 is selected such that it is somewhat larger than the outside diameter of the correction wheel 7 of FIG. 2 yet smaller than the outside diameter of the thumb piece 9. The slot 14 has a width which is somewhat larger than the thickness of the flattened of thinned portion 11 of the pin 8. Further, the smaller opening 15 has a diameter which is somewhat larger than the outside diameter of the shaft 8.

The correction wheel 7 thus moulded integrally with the thumb piece 9 will be mounted in a predetermined position inside the casing 1 through the following procedure. First, the thumb piece 9 is held by hand and the integral stub 10, wheel 7 and shaft 8 are inserted into the larger opening 13 of the cover 12 from the outside of the same. The thumb piece 9 is manually rotated until the flat faces 11 on the shaft 8 become parallel with the slot 14 in the cover 12.

The collector element is then moved along the slot 14 to the position where the shaft 14 fits in the smaller opening 15.

Thereupon, the cover 12 is secured to the casing 1 by small screws. Under this condition, the wheel 7 on the collector body is brought into mesh with the wheel mechanism 5 by a small amount of rotation of the thumb piece 9 while at the same time the stub 10 is fitted in an opening which is formed in the bottom wall (not shown) of the casing 1.

At the end of the above-mentioned procedure, the wheel 7 will become supported in the predetermined meshed position by first and second bearings: the opening (not shown) of the casing 1 in which the stub 10 is engaged and the smaller opening 15 of the cover 12 in which the shaft 8 is engaged. The thumb piece 9 is now ready to be rotated in either direction smoothly whenever correction of time is desired.

Where it is necessary to remove the wheel 7 as for repair or inspection purpose, the cover 12 will be demounted from the casing 1 whereby the wheel 7 will be taken out while being suspended from the cover 12 with the aid of the thumb piece 9 integral therewith. Then the wheel 7 may be removed even from the cover 12 merely by moving the corrector element along the slot 14 with the flat faces 11 held in parallel with the slot 14, until the wheel 7 is brought back into registry with the larger opening 13 of the cover 12.

In summary, a corrector wheel embodying the present invention is moulded integrally with a thumb piece for correction and a rotary shaft interconnecting the wheel and thumb piece. This cuts down the number of necessary component parts compared with the prior art assembly. Furthermore, the rotary shaft is locally thinned to have a pair of parallel flat surfaces. A cover on the other hand is formed with a larger diameter circular opening capable of passing the corrector wheel therethrough, a slot allowing the shaft to move therethrough with the flat surfaces held in parallel therewith, and a small diameter circular opening permitting manipulation of the thumb piece in a predetermined position for correction; the larger and smaller openings are communicated to each other by the slot. With such an arrangement, the corrector wheel can be readily put into or out of its operative position because mere removal of the cover will make the wheel to become suspended from the cover. This is contrastive to the conventional procedure wherein a cover must be demounted after removal of a thumb piece or attached before fitting the thumb piece.

What is claimed is:

1. In combination with a time piece, a slip device comprising: a minute wheel; a minute shaft having a flange at one end portion thereof, said flange having a diameter smaller than said minute wheel, said minute wheel being in abutting engagement with said flange on a first side thereof; and resilient means abutting against said flange on a second side thereof, said resilient means including an annular relatively thin plate having an outside diameter larger than that of said flange and engaged around said minute shaft, said annular plate being formed with a pair of substantially semi-circular symmetric slots to define an outer annular portion, said outer annular portion being connected to the minute wheel at a plurality of locations thereof.

2. The combination according to claim 1, in which said minute shaft includes a stub on said first side and a shaft on said second side.

3. The combination according to claim 2, in which said minute wheel has an opening therein.

4. In combination: a printed circuit board, a battery and a terminal plate structure for establishing electrical connection across said printed circuit board and said battery in a timepiece, a movement casing of said timepiece having first and second projections protruding from inside walls thereof, said terminal plate structure comprising a pair of strip-shaped elastic members having inverted U-shaped notches respectively arranged substantially in intermediate portions thereof, said notches engaging said projections, each strip-shaped elastic member being notched to form an L-shaped portion at a first end thereof, said L-shaped portion being bent at an obtuse angle inwardly of the movement casing, said L-shaped portion being formed at an end thereof with a tongue-shaped portion which is bent inwardly substantially at a right angle thereto, whereby said strip-shaped elastic members pressingly hold said printed circuit board due to the resiliency of said L-shaped portions and, at the same time, electrically contact said printed circuit board.

5. The combination according to claim 4, in which said pair of strip-shaped elastic members include a positive terminal plate and a negative terminal plate.

6. In combination with a timepiece: an integral molding of a stub, a correction wheel, a rotary shaft, and a thumb piece for correction, said rotary shaft being locally thinned at a portion thereof adjacent said thumb piece so as to have a pair of parallel flat surfaces; and a cover for a movement casing of said timepiece formed with a first circular opening permitting passing of the correction wheel therethrough, said cover having a slot extending from said first opening of the cover to permit the thinned portion of the rotary shaft to move therein, and said cover also having a second circular opening of a diameter smaller than said first circular opening at which said slot terminates and which permits the rotary shaft to rotate therein.

* * * * *